United States Patent [19]

Mukri

[11] 4,288,092

[45] Sep. 8, 1981

[54] SKI ACCESSORY

[76] Inventor: Louis E. Mukri, 13000 Roselle Ave., Hawthorne, Calif. 90250

[21] Appl. No.: 5,151

[22] Filed: Jan. 22, 1979

[51] Int. Cl.[3] ..... A63C 5/00

[52] U.S. Cl. ..... 280/605

[58] Field of Search ..... 280/605, 604, 601, 607, 280/608, 609

[56] References Cited

U.S. PATENT DOCUMENTS

| | | | |
|---|---|---|---|
| 3,378,274 | 4/1968 | Poppen | 280/609 |
| 3,404,900 | 10/1968 | Rippetoe | 280/609 |
| 3,899,184 | 8/1975 | Haddad | 280/605 |

FOREIGN PATENT DOCUMENTS

| | | | |
|---|---|---|---|
| 38591 | 8/1909 | Austria | 280/605 |
| 616580 | 3/1961 | Canada | 280/605 |
| 200314 | 7/1908 | Fed. Rep. of Germany | 280/605 |
| 418600 | 9/1925 | Fed. Rep. of Germany | 280/605 |
| 155832 | 3/1939 | Fed. Rep. of Germany | 280/605 |
| 1110207 | 2/1956 | France | 280/605 |
| 428231 | 12/1947 | Italy | 280/604 |
| 39614 | 2/1907 | Switzerland | 280/605 |
| 75461 | 12/1916 | Switzerland | 280/605 |
| 218388 | 8/1941 | Switzerland | 280/605 |

*Primary Examiner*—Robert J. Spar
*Assistant Examiner*—Kenneth Noland
*Attorney, Agent, or Firm*—John H. Crowe

[57] ABSTRACT

A sub-chassis channel member having a web portion underlying a ski and side portions straddling the sides of the ski is connected to a chassis member overlying the ski. A snow traction cleat located rearwardly of the sub-chassis member and having a web portion underlying the ski is pivotally supported by the chassis member to trail in contact with the snow surface during forward movement and to penetrate the snow surface a limited amount upon rearward movement.

A resilient deflector plate extends forwardly and upwardly from the bottom of the web portion of the sub-chassis member to press against the bottom of the ski and to ride over the surface of the snow compacted thereby to prevent build-up of the snow at the leading edge of the sub-chassis member and the traction member.

Ice traction blades are pivotally supported by the sub-chassis member to extend parallel to the sides of the ski and have sharp ice penetrating points which trail during forward ski movement. When the ski is raised and then dropped on any icy surface, the blade points penetrate the ice and permit forward movement only.

The snow traction cleat can be selectively held in partly lowered position to retard the ski during downhill skiing. Marker devices can be mounted in different positions across the width of the ski to mark the ski trail with coded intelligible information.

5 Claims, 14 Drawing Figures

FIG. 1.
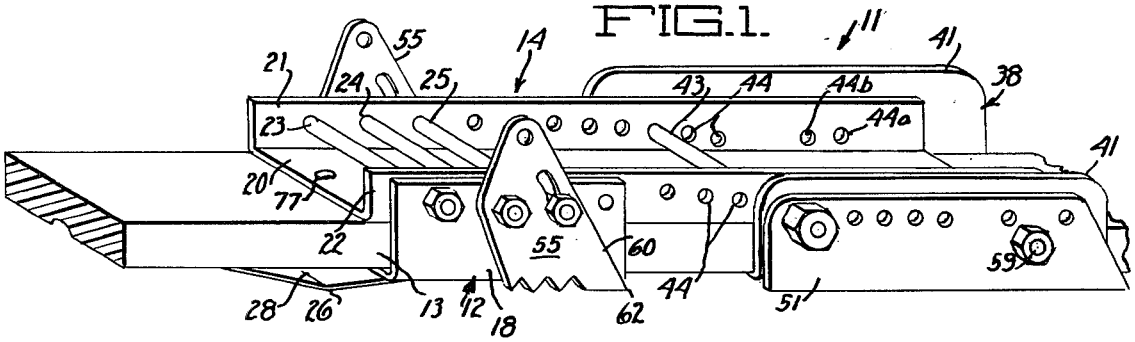
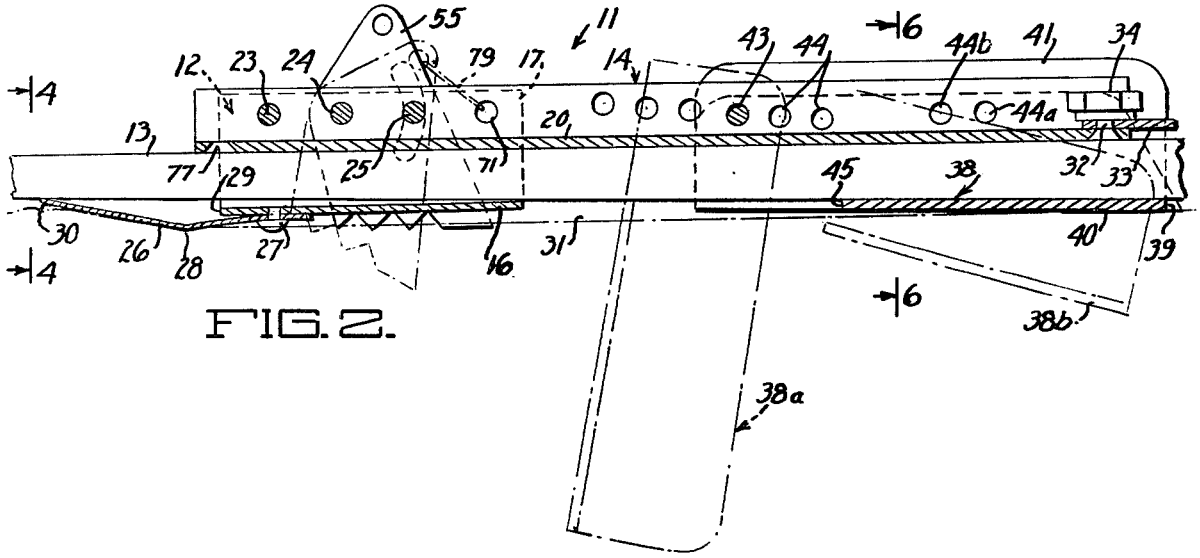
FIG. 2.
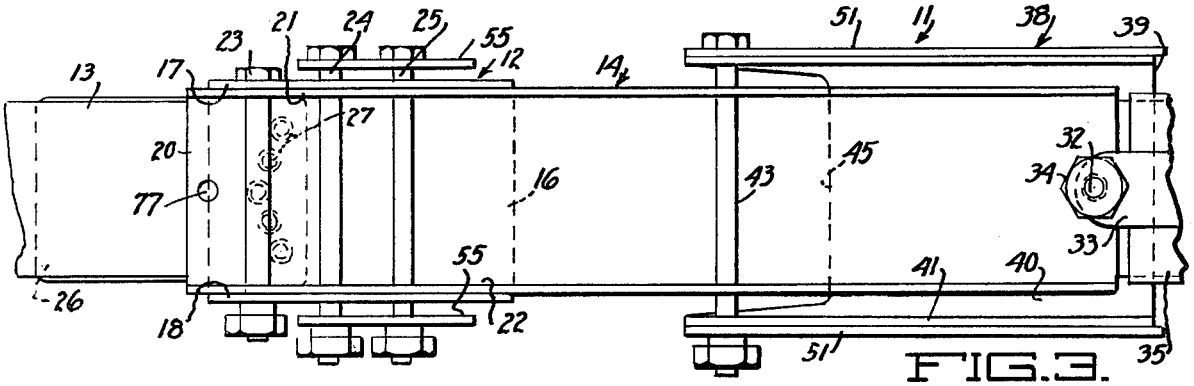
FIG. 3.
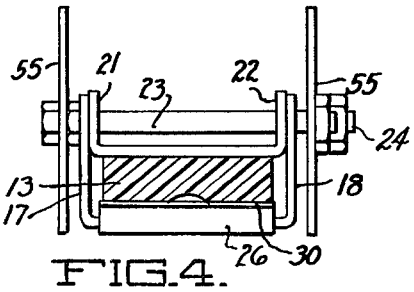
FIG. 4.
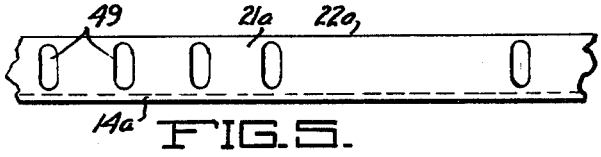
FIG. 5.

SKI ACCESSORY

BACKGROUND OF THE INVENTION

1. Field of the Invention

This invention relates to snow skis and has particular reference to devices for effecting traction and speed control of skis.

2. Description of the Prior Art

Certain types of skiers, such as military personnel, forest servicemen, explorers, etc. often travel over relatively steep snow and ice covered mountains or other uneven terrain. Although certain procedures can be followed in climbing and descending steep slopes on skis, such procedures are tiring and often hazardous, particularly under icy conditions and when the skier is carrying a heavy pack.

Attempts have been made heretofore to provide traction devices to aid skiers in climbing steep slopes but there have been certain drawbacks which have prevented them from being used generally. For example, the U.S. Pat. No. 2,358,213 issued to A. Courage illustrates a traction device attachable to a ski for climbing snow and ice covered slopes. Such device, however, tends to retard forward travel during level or downhill skiing because of the tendency of snow to build up in front of any object which projects below the bottom of the ski. Therefore, the device must be removed after each climb.

The U.S. Pat. No. 3,724,867 to N.F. Hawthorne discloses another type of traction device intended to be permanently attached to a ski. The device has settable spurs which, when set, extend downwardly along the side of the ski for traction purposes. The spurs, however, cannot equally well provide traction in climbing on soft snow and hard ice. That is, if the spurs are made wide enough to be effective in soft snow they would be ineffective to penetrate an ice surface. Also, such spurs must be set and retracted as conditions change during climbing and downhill skiing.

SUMMARY OF THE INVENTION

A principal object of the present invention is to provide a traction device for skis to enable climbing slopes covered with snow as well as ice.

Another object is to provide a traction device of the above type which operates automatically and does not impede movement of the skis during level or downhill skiing.

Another object is to provide a ski accessory which will enable the skier to traverse the sides of steep slopes covered with either ice or snow.

A further object is to provide a ski accessory which will selectively retard the speed of skis during downhill skiing.

A further object is to provide a traction device for skis to selectively enable climbing backwards.

A further object is to provide an accessory of the above type with means for storing and carrying small items.

A still further object is to provide a ski accessory device with means for making a ski trail with intelligible information.

A further object is to provide a ski accessory of the above type which is reliable, lightweight, rugged and inexpensive to manufacture and assemble.

A further object is to provide a ski accessory capable of traction uphill and across snow and ice free surfaces such as forest carpet and hard rock strewn soil.

According to the basic aspects of the invention, a ski accessory is provided to be removably mounted on a ski for automatically providing forward traction while climbing snow and ice covered slopes and for permitting downhill or level skiing, while resisting side slipping when traversing the side of a slope. The accessory device comprises a sub-chassis channel member having a bottom web to extend under the ski and sides which straddle the ski and are secured to a chassis member overlying the ski and extending rearwardly from the sub-chassis member.

A snow traction cleat is pivotally connected to the chassis member rearwardly of the sub-chassis member and has a web section to underly the ski. The cleat trails over the snow during forward ski movement and swings down into the snow a limited amount upon rearward ski movement, the amount of such penetration being adjustable.

A flexible deflector plate is attached to the bottom of the web of the sub-chassis member and extends forwardly and upwardly to yieldably engage the leading edge thereof with the bottom of the ski to press downwardly against the surface of the snow. Thus, the deflector plate rides over the surface of the underlying snow and holds the adjacent portion of the ski slightly above the snow surface whereby preventing the snow from building up in front of the leading edge of the deflector plate, the sub-chassis member or the traction member, and permitting unimpeded forward downhill or level skiing.

Thin ice traction blades are pivotally mounted on the sub-chassis member or the traction cleat and extend in planes parallel to the length of the ski. Such blades are provided with sharp points which normally trail along the surface but when the ski is raised each blade swings to such a position that when it is again lowered the points penetrate the ice surface to prevent rearward slipping movement of the ski. The trailing portion of each traction blade forms a knife edge to engage the ice surface and thus form a slight groove to resist side slipping. The blades can be selectively locked in penetrating position to act as ice "cramp-ons" and to act as keel fins in traversing soft snow to resist side slipping without appreciably impeding forward movement.

According to other aspects of the invention, a thin slab forming a knife edge is secured to each side section of the traction cleat to act as a keel fin to reduce side slipping, especially when traversing snow covered slopes. Scribing members are mountable in different positions on the sub-chassis member or on the traction cleat to extend downwardly into the ski trail to form marker grooves which, by virtue of their placement laterally in different positions relative to the trail, will convey coded information, such as the identity of the skier.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a perspective view of a ski accessory device embodying a preferred form of the present invention and showing the same mounted on a ski and resting on a supporting surface, the ski being partly broken away.

FIG. 2 is a longitudinal sectional view through the ski accessory.

FIG. 3 is a plan view of the ski accessory.

FIG. 4 is a transverse sectional view taken along the line 4—4 of FIG. 2.

FIG. 5 is a side view of the chassis member, partly broken away, showing another means for adjusting the pivot support for the traction cleat.

DESCRIPTION OF THE PREFERRED EMBODIMENT

Figure 6:
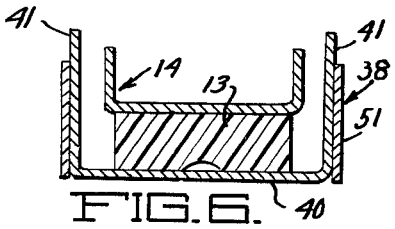
FIG. 6 is a transverse sectional view taken along the line 6—6 of FIG. 2.

Although this invention is susceptible to embodiment in many different forms, there is shown in the drawings and will be described in detail one specific embodiment, with the understanding that the present disclosure is to be considered as an exemplification of the principles of the invention and is not intended to limit the invention to the embodiment illustrated. The scope of the invention will be pointed out in the appended claims.

Referring to the drawings, the accessory device is generally indicated at 11, FIGS. 1, 2, 3 and 13, and comprises basically a sub-chassis member 12 which underlies a conventional ski, partly shown at 13, and a top chassis member 14 overlying the ski. The forward or leading end of the ski 13 is considered to be at the left of FIGS. 1 to 3 and the device is preferably located directly in front of the usual ski bindings, a part of which is shown at 15 in FIG. 8.

The sub-chassis 12 is in the form of a channel member having a web portion 16 underlying the ski 13 and side portions 17 and 18 which loosely straddle the sides of the ski 13. The chassis member 14 is also in the form of a channel member having a web section 20 resting on top of the ski and upstanding side sections 21 and 22 which fit between the side sections 17, 18, respectively, of the sub-chassis member 12 and are held in position by bolts 23, 24 and 25.

A thin resilient deflecting plate 26 having a width substantially the same as that of the ski 13, is attached by a series of rivets 27 to the bottom of the web portion 16 and extends forwardly to a bend line 28 and then upwardly at a relatively acute angle, causing its leading edge 30 to yieldably engage the bottom surface of the ski 13. The deflector plate 26 thus resiliently holds the forward end of the chassis member 14 against the top surface of the ski 13 and, depending upon the thickness of the ski, there is a small amount of clearance between the left hand part of the web portion 16 and the bottom of the ski. This construction permits the ski to flex and twist as the skier rides over uneven terrain. Also, the construction permits mounting the sub-chassis member onto the ski without requiring fasteners such as screws to be attached to the ski. However, another important feature of this construction is that as the ski advances forwardly, the deflector plate rides over the surface of the snow, compacting the same, and forming a smooth surface indicated by the dot-dash line 31 in FIG. 2, thereby holding the adjacent bottom surface of the ski somewhat above the snow surface at this point and thus preventing the snow from building up in front of both the leading edge 30 of the deflector plate and the leading edge 29 of the web portion 16 of the sub-chassis member, which build-up would otherwise retard forward movement of the ski in downhill skiing.

Figure 8:
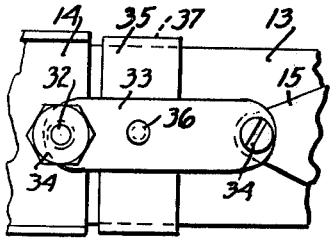
FIG. 8 is a plan view of the connecting means for connecting the rear end of the chassis member to a part of an existing ski boot mounting.

Means are provided to attach the rear end of the chassis member 14 to the ski without having to drill fastener holes other than those already existing for the ski binding 15. As seen in FIGS. 2 and 8, a screw 32 is passed upwardly through the rear end of the web portion 20 of chassis member 14 and through a connecting link 33 and is held in place by a nut 34. The link 33 is attached by an existing screw 34 to the binding element 15 and an inverted U-shaped member 35 is attached to the link 33 at 36 and has downwardly extending arms 37 which straddle the sides of the ski to prevent lateral movement of the rear end of the chassis member 14.

A snow traction member or cleat 38 is located rearwardly of the sub-chassis member 12 and comprises a channel element having a web portion 40 underlying the ski 13 and upwardly extending side portions 41 which loosely straddle the sides of the ski and the side portions 21 and 22 of the chassis member 14.

Figure 9:
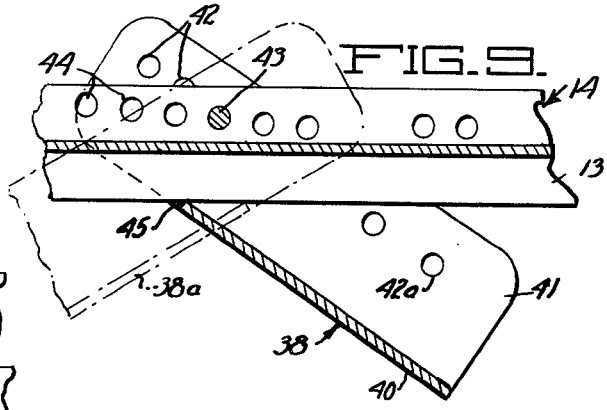
FIG. 9 is a sectional view, similar to FIG. 2, but partly broken away, and showing an alternative pivot mounting of the traction cleat.

A series of spaced bearings holes 42, FIG. 9, are formed in the cleat side sections 41, permitting an axle bolt 43 to be passed through selected ones thereof and through selected ones of a second series of bearing holes 44 formed in the side flanges 21 and 22 of the chassis member 14 to permit pivotal movement of the cleat 38 between its upper closed position illustrated in FIGS. 1 and 2 and a lower open position as shown, for example, by the dot-dash lines **38*a* of FIG. 2**.

During forward movement of the ski, the cleat 38 trails over the surface of the snow with the web portion 40 in contact with the lower surface of the ski 13 and in the trail left by the deflector plate 26. Since the surface 31 of such trail, as noted before, extends in a straight line rearwardly from the deflector plate 26, it lies below the leading edge 45 of the web portion 40 of the cleat and thus there is little or no tendency for the snow to build up in front of such edge.

In climbing, and when the ski tends to slide rearwardly, the trailing edge 39 of the cleat web portion 40 penetrates the snow surface and swings downwardly until the leading edge 45 limits against the ski bottom, thereby holding the cleat in a position preventing rearward movement of the ski although permitting counterclockwise swinging movement thereof so that the skier may alternately advance his two skis to readily travel uphill.

It will be noted that the bearing holes 44 in the sides 21 and 22 of the chassis member 14 are located in a row which progressively lowers rearwardly toward the web portion 20. The axle bolt 43 may be placed in different sets of holes 44, depending on the thickness of the ski, to insure that the web portion 40 of the cleat 38 normally rests against the bottom surface of the ski. Also, by placing the axle bolt 43 in different sets of the holes 42 in the sides of the cleat, the radius of movement thereof and the angle through which it swings may be varied as determined by the type of snow encountered, the weight of the skier, etc. That is, when the bolt 43 is mounted in a hole 42 near the left hand end of the cleat 38, the latter will swing through a greater radius and through a greater angle than if the bolt were mounted in a hole 42 closer to the right hand end of the cleat.

FIG. 9 illustrates the axle bolt 43 as being passed through the third set of bearing holes 42, from the left, in the cleat 38 in which case the cleat will be limited by engagement of the leading edge 45 with the ski bottom to thus hold the cleat in its full line position shown in that figure upon rearward sliding movement of the ski.

The right hand bearing holes **42*a* in the cleat 38 are so located that when the axle bolt 43 is passed therethrough, the cleat will be held in its normal position shown in FIGS. 1 and 2** and therefore no uphill traction effect will result. This may be desirable in cases where only downhill skiing is encountered or in carrying the skis.

FIG. 5 illustrates another embodiment of the invention wherein vertical slots 49 may be formed in the side portions **21*a* and 22*a* of the chassis member 14*a* in lieu of the holes 44**, permitting adjustable mounting of the axle bolt for the traction cleat therein.

The cleat 38 may be readily reversed, as indicated by the dot-dash lines **38*a* in FIG. 9** to obtain traction when skiing in a rearward direction only, thus enabling the skier to climb a slope backwards if he desires.

Figure 7:
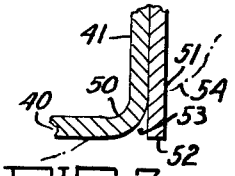
FIG. 7 is an enlarged fragmentary sectional view of the detail shown in the lower right hand corner of FIG. 6.

As seen in FIGS. 6 and 7, the cleat 38 is preferably formed of sheet metal having rounded corners 50 at the juncture of the web portion 40 and the side portions 41. Thin planar runner slabs 51 are removably fastened to the side sections 41 as by the bolt 43 and additional fasteners, such as nut and bolt 59. The lower edges 52 of such slabs 51 are substantially level with the bottom surface of the web portion 40 and extend substantially the length of the cleat 38 to both strengthen the cleat and to form a knife edge to resist side slipping of the ski. As the ski moves forwardly, the underlying snow is forced into the resulting opening 53 adjacent the rounded corner 50, forming a ridge which extends the length of the cleat 38 and aids the running edge 52 in holding the ski against side slipping, particularly when traversing a steep slope as indicated by the dot-dash line 54. Since the slab 51 presents only a small frontal area, it does not appreciably impede the forward movement of the ski but since it extends the length of the cleat 38 it effectively reduces any side slipping tendency.

As seen particularly in FIGS. 3 and 6, the cleat 38 is considerably wider than the chassis member 14 to permit a limited transverse shifting of the cleat to prevent snow, ice, rocks or the like from lodging in between the sides of the cleat and the chassis member. Such extra width also provides an outrigger effect to better laterally stabilize the ski The cleat 38 may also be used as a brake to retard downhill speed. For this purpose a bolt, not shown, may be placed in the holes **44*a* in the chassis sides 21 and 22 to hold the cleat in its dot-dash line angular position 38*b*, FIG. 2, to effect a drag against the snow surface. Alternatively, the cleat 38 may be set at a steeper angle to provide a greater retarding effect by placing the bolt in its holes 44*b***.

The web portion 20 and side portions 21 and 22 of the member 14 which extend rearward of the axle bolt 43 form a compartment for storing small items such as flares, first aid equipment, cord, etc. Such items may be fastened in place by cord, not shown, passed through various ones of the holes 44. Alternatively, a cover, not shown, may be pivotally supported on the axle bolt 43 and normally latched in closed position to contain such items in place.

Means are provided to effect traction when traveling over ice or icy snow. For this purpose, ice traction blades 55, FIGS. 1 to 4 and 10, are pivotally mounted on the aformentioned bolt 24 to extend in planes parallel to the length of the ski 13. Each blade 55 may also shift laterally a limited amount on its bolt 24 to prevent ice, etc., from lodging between it and the side of member 12. Each blade 55 is permitted to swing a limited amount between its full line illustrated position shown in FIG. 10 and its dot-dash line position **55*a* by means of an arcuate slot 57 therein which embraces the bolt 25**.

The blade 55 has a traction edge 60 which intersects a running edge 61 at an angle of less than 90° to form a sharp ice penetrating corner or point 62. The blade 55 is formed with its center of gravity located substantially at point 63, rearwardly of a line a passing through the axis of the pivot bolt 24 and the corner 62 when the blade is free to pivot. Thus, when the ski is lifted above the supporting surface of ice or the like, the blade will freely pivot clockwise until limited by the bolt 25 as it is engaged by the upper end of slot 57. In this position, the traction edge 60 forms an acute angle b relative to a line c extending at right angles to the length of the ski. Accordingly, when the skier forces the ski downward against the supporting surface, the sharp corner 62 will penetrate the ice and will prevent the blade from rocking clockwise to thus prevent the ski from sliding rearwardly. However, the skier may, with one ski anchored, slide the other forwardly whereupon the corresponding traction blade 55 will readily rock counterclockwise about the corner 62 until it reaches its running position wherein the running edge 61 extends parallel to but slightly below the bottom of the ski. A set of serrated teeth 64 are preferably formed in the running edge 61 of each blade 55 to cut a running groove in the surface of the ice during forward movement of the ski to track the ski and thus reduce side slipping.

Figure 10:
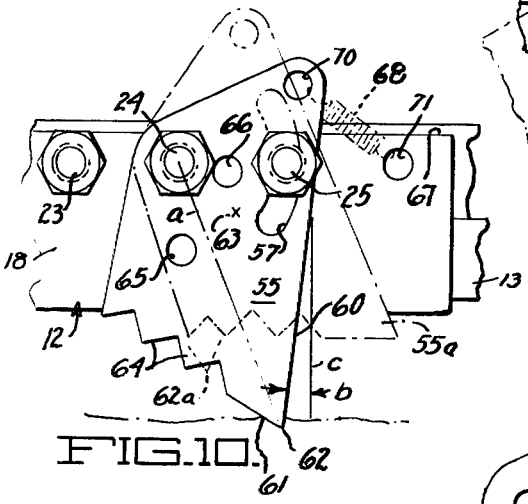
FIG. 10 is an enlarged side view of one of the ice traction blades and its mounting.

Holes 65 and 66 are formed in the blade 55 to permit relocating of the same to provide a shorter penetration into the ice than occurs when the blade is pivotally supported as shown in FIG. 10. In this case, bolt 25 is removed; the bearing hole 65 is placed over the axle bolt 24 and a limiting stud (not shown) is forced into the hole 66 to limit against the upper edge 67 of the sub-chassis member 12. The point 62 will not assume a position indicated by the dotted lines **62*a*. In such position, the skier does not have to elevate the ski above the supporting surface as high as is necessitated by the pivotal connection shown in full lines in FIG. 10**.

The blade 55 may alternatively be yieldably urged into its full line position of FIG. 10 by a tension spring shown by dot-dash lines 68 extending between holes 70 in the blade and 71 in the side of the sub-chassis member 12. On the other hand, the blade may be locked in its full line position of FIG. 10 or its dot-dash line position of FIG. 2 by a suitable clip 79 extending between the holes 70 and 71 to thereby act as a "cramp-on" in cases where extensive traveling is to be done over hard ice. In such a position, the ski may also traverse relatively soft snow without the blade impeding foward movement while, at the same time, the blade acts as a keel fin to reduce side slipping.

Figure 11:
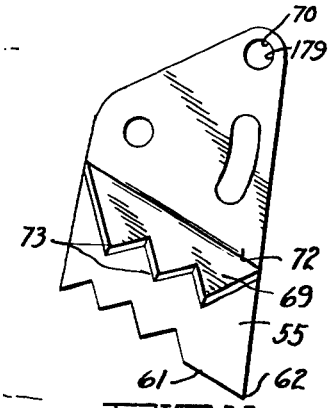
FIG. 11 is an enlarged side view of one of the ice traction blades with an auxiliary side slip preventing blade attached thereto.
Figure 12:
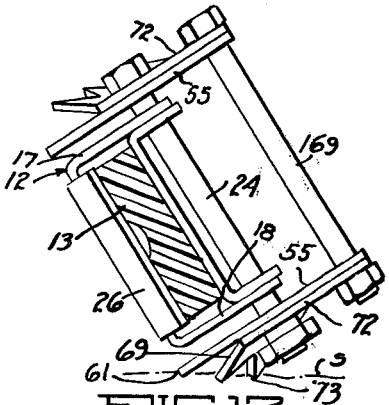
FIG. 12 is a transverse sectional view, similar to FIG. 4, illustrating the auxiliary side slip preventing blade in ice gripping position when the ski and accessory device are tilted laterally.

FIGS. 11 and 12 illustrate a modification of the invention in which an anti-side slip blade 72 is provided alongside each ice traction blade 55. Each blade 72 has an outwardly diverging portion 69 which terminates in serrated teeth 73 which are located above the level of the running edge 61 of the associated blade 55 so that they normally do not engage the supporting surface. However, if the ski should be tilted laterally into a position as shown in FIG. 12, the teeth 73 will penetrate the ice surface, i.e. "s," and thus prevent side slipping.

As shown in FIG. 11, the blade 72 may be secured to the side of the associated blade 55 as by welding, or, as shown in FIG. 12, the blade 72 may be separate from blade 55 but constrained to pivot therewith about the bolt 24 by a cross rod 169 which passes through the hole 70 in each blade 55 and through a similar hole 179 in each blade 72. In the latter case, the blade 55 may be readily removed, leaving only the blades 72 in place.

It will be noted that considerable space is left between the blade 55 and the sides 17 and 18 of the sub-chassis member 12 to allow the blades 55 and 72 to "float" laterally to reduce the possibility of ice and debris lodging between such elements.

Figure 13:
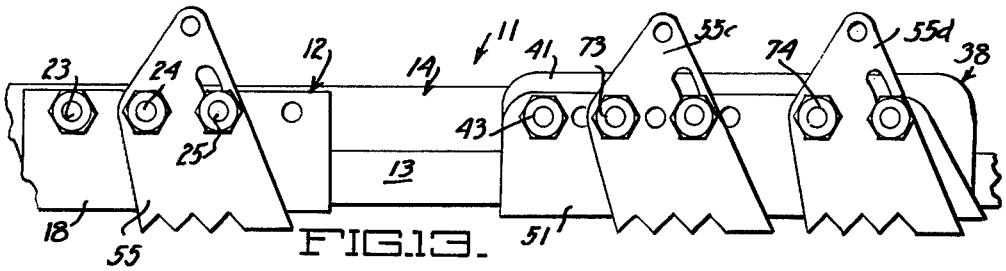
FIG. 13 is a side view of the accessory device with a series of ice traction blades pivotally mounted thereon.

As seen in FIG. 13, several additional ice traction blades **55*c* and 55*d* may be provided. The latter are pivotally supported on short axle bolts 73 and 74, respectively, which are passed through respective ones of the side portions of the cleat 38 to perform the same functions as blade 55**.

Figure 14:
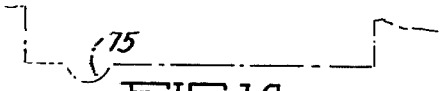
FIG. 14 is a transverse sectional view of a ski trail formed in soft snow with an identifying groove therein by the device of the present invention.

According to another aspect of the invention, means are provided to form a coded intelligence marker or groove on the ski trail. This may be used, for example, to identify the particular skier or to convey a particular coded message to anyone later viewing the trail. For this purpose, certain of the rivets 27, FIGS. 2 and 3, may be formed flush with the bottom surface of the web portion 16 of sub-chassis member 12 and other selected rivets would be provided with rounded downwardly projecting heads. Accordingly, as seen in FIG. 14, which depicts a cross-section of a trail produced by the ski, one or more grooves 75 are scribed in a particular lateral location relative to the width of the groove. In the embodiment shown in FIG. 3, five rivets 27 are provided for each ski or a total of 10 rivets for two skis, any one or combination of which may have rounded heads. In this case, 100 coded combinations could be formed. Alternatively, the rivets 27 or similar ones could be mounted on the underside of the cleat 38 for the same purpose.

Although, as depicted in the drawings, the accessory device 11 is preferably located in front of the ski boot mounting, it may also be mounted at the rear of such mounting, and for this purpose, a hole 77, FIGS. 1 to 3, is formed at the forward end of the chassis member 14 for suitable attachment to a part of the rear end of the ski boot mounting. Also, in cases where severe ice conditions may occur, two accessory devices 11 may be mounted on each ski, one in the front and the other in back of the ski boot mounting. Also, in cases where ice is predominately encountered, the traction cleat 38 may be omitted whereas, in cases where snow is predominately encountered, the ice traction blades 55 may be omitted.

I claim:

1. An accessory device for a ski having a forward leading end comprising:

a channel member having a web portion to extend under said ski and upwardly extending side portions to straddle the sides of said ski, a chassis member to extend over said ski, means for attaching said side portions of said channel member to said chassis member, and a resilient deflector plate secured at the rear thereof to the bottom of said web portion and extending upwardly and forwardly to engage the forward end thereof against the bottom of said ski and to yieldably hold said chassis member against the top of said ski, said accessory device also comprising:

a traction member, means pivotally supporting said traction member on said chassis member for trailing movement over the snow during forward movement of said ski and for downward swinging movement to penetrate the snow upon rearward movement of said ski, and means for limiting said downward movement of said traction member, said traction member comprising a channel element having a web section to extend under said ski and side sections to straddle said sides of said ski, said deflector plate and said web section supporting the intermediate bottom portion of said ski above the surface of the snow during forward movement of said ski.

2. An accessory device as defined in claim 1 wherein said limiting means comprises means for selectively limiting said swinging movement of said traction member to different angles relative to the length of said ski.

3. An accessory device as defined in claim 1 wherein said chassis member comprises a second channel element having a web section to engage the top of said ski and upwardly extending side sections, said pivotal means comprising a bearing hole in at least one of said side sections of said fist mentioned channel element, a plurality of additional bearing holes in at least one of said side sections of said second channel element, said additional holes being spaced lengthwise along said second channel element and at different heights above said web section thereof, and an axle element removably mounted in said first bearing hole and in any of said additional bearing holes.

4. An accessory device as defined in claim 1 comprising a thin planar element integral with at least one of said side sections of said channel element and extending along the length of said channel element, said planar element having a lower edge engageable with the snow to form a groove therein whereby to resist lateral movement of said ski.

5. An accessory device for a ski having a forward leading end comprising:

a channel member having a web portion to extend under said ski and upwardly extending side portions to straddle the sides of said ski, a chassis member to extend over said ski, means for attaching said side portions of said channel member to said chassis member, and a resilient deflector plate secured at the rear thereof to the bottom of said web portion and extending upwardly and forwardly to engage the forward end thereof against the bottom of said ski and to yieldably hold said chassis member against the top of said ski, said accessory device also comprising:

a traction member, means pivotally supporting said traction member on said chassis member for trailing movement over the snow during forward movement of said ski and for downward swinging movement to penetrate the snow upon rearward movement of said ski, and means for limiting said downward movement of said traction member, said traction member comprising a channel element having a web section to extend under said ski and side sections to straddle said sides of said ski, said means pivotally supporting said traction member comprising:

a first bearing hole in said chassis member, a plurality of additional bearing holes in at least one of said side sections of said traction member, said additional bearing holes being spaced lengthwise of said traction member, and an axle element removably mounted in said first bearing hole and in any selected one of said additional bearing holes whereby to vary the depth to which said traction member can penetrate the snow.

* * * * *